US008038455B1

(12) United States Patent
Moraes et al.

(10) Patent No.: US 8,038,455 B1
(45) Date of Patent: Oct. 18, 2011

(54) CONNECTOR ASSEMBLY HAVING RETRACTABLE STABILIZER INCLUDING INWARD FLEXING SECURING MEMBER

(75) Inventors: Joao A. Moraes, São Paulo (BR); Marcio Ferrucio, São Paulo (BR); Robert Ziemba, Kraków (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/913,864

(22) Filed: Oct. 28, 2010

(51) Int. Cl.
*H01R 13/44* (2006.01)

(52) U.S. Cl. ..... 439/140

(58) Field of Classification Search ..... 439/140, 439/141, 157, 374, 372, 378, 752
See application file for complete search history.

(56) References Cited

U.S. PATENT DOCUMENTS 5,879,174 A 3/1999 Kountz et al.
6,422,881 B1 7/2002 Puhl et al.
6,761,568 B2 * 7/2004 Bakker et al. ..... 439/140
6,846,191 B2 1/2005 Hobbs et al.
6,896,531 B2 5/2005 Bakker et al.

* cited by examiner

*Primary Examiner* — Chandrika Prasad
(74) *Attorney, Agent, or Firm* — Thomas N. Twomey

(57) ABSTRACT

A connector assembly includes a retractable stabilizer moveable between a blade alignment position and a seated position in a shroud of a male connector. The retractable stabilizer is in the blade alignment position when the connector assembly is unmated and in the seated position when the connector assembly is mated. The retractable stabilizer includes a base and at least one position arm, at least one retention feature, and a securing member that extend from the base. When the connector assembly is unmated, the female connector pulls on the securing member which draws the retractable stabilizer to move from the seated position back towards the blade alignment position. When the at least one retention feature engages a blocking feature on the shroud, the at least one position arm flexes into at least one aperture defined in the shroud to secure the retractable stabilizer at the blade assembly position for reuse.

20 Claims, 8 Drawing Sheets

CONNECTOR ASSEMBLY HAVING RETRACTABLE STABILIZER INCLUDING INWARD FLEXING SECURING MEMBER

TECHNICAL FIELD

The present invention relates to an electrical connector assembly, more particularly, an electrical connector assembly employs a retractable stabilizer having a low coupling force.

BACKGROUND OF INVENTION

It is known to use a retractable stabilizer in an electrical connection system, such as may be found in automotive electrical wiring systems. The retractable stabilizer is disposed in a housing of a male connector and moves in the male connector to protect and stabilize male terminals during their connection with female terminals in a corresponding female connector when the male and the female connector are connected together. Stabilizers also assist to keep undesired foreign matter, or debris out of the connector system environment to prevent intermittent electrical connections between the mated terminals and prevent blockage between the connectors that may impede the mating of the connection system.

The retractable stabilizer is moveable between a blade alignment position and a seated position in a housing of the male connector. In the blade alignment position, distal tips of the male terminals are exposed above a surface of the stabilizer facing the incoming female terminals. With connection of the connection system, the female connector makes contact with the stabilizer and urges the stabilizer deep into the male connector that increasingly exposes the male terminals for electrical connection with the advancing insertion of the female terminals. When the connection system is unconnected, the female connector interacts with the stabilizer so that the stabilizer moves back to the blade alignment position for reuse when the connection system is again reconnected. The construction and manufacture of current retractable stabilizer connection systems is such that these systems have retractable stabilizers that require an undesired high coupling force to operate during the mating and unmating of the connection system. It is desirable to have a low coupling force of the connection system during manufacture of a vehicle as this makes it easier for an assembly operator to mate the connection system together and may result in decreased hand and arm fatigue for the assembly operator. Reducing the coupling force to operate the retractable stabilizer reduces the overall coupling force needed to mate and unmate the connection system. As current connection system configurations age over their useful service life in an application, such as a vehicular application, the elements of the connection system, including the retractable stabilizer, may become fatigued where the retractable stabilizer may not retract back to the blade alignment position for reuse when the connection system is unmated. If the retractable stabilizer remains undesirably positioned deep in the male connector when the connection system is unconnected, an increased portion of the male terminals are exposed above the retractable stabilizer which increases the risk for male terminal damage, such as having bent or broken terminals, when connection system is reconnected. Damaged male terminals require servicing to the connection system which undesirably increases repair costs of the connection system.

Accordingly, what is needed is a reliable electrical connector assembly that has a retractable stabilizer that operates with less coupling force to protect the male terminals where the connector assembly mates and unmates while providing robust retractable stabilizer operation over a service life of the connector assembly.

SUMMARY OF THE INVENTION

In accordance with a preferred embodiment of the invention, a connector assembly includes a retractable stabilizer having a low coupling force. The retractable stabilizer moves between a blade alignment position and a seated position in a shroud of the male connector during operation of the connector assembly. The retractable stabilizer includes a base. The base includes a position arm, a retention feature, and a securing member. When the connector assembly is unmated, the female connector pulls on the securing member which draws the retractable stabilizer from the seated position back towards the blade alignment position. When the retention feature engages a blocking feature disposed on the shroud of the male connector, the position arm flexes into an aperture defined in the shroud to secure the retractable stabilizer at the blade assembly position for reuse.

BRIEF DESCRIPTION OF THE DRAWINGS

This invention will be further described with reference to the accompanying drawings in which.

DETAILED DESCRIPTION OF THE PREFERRED EMBODIMENTS

Figure 1:
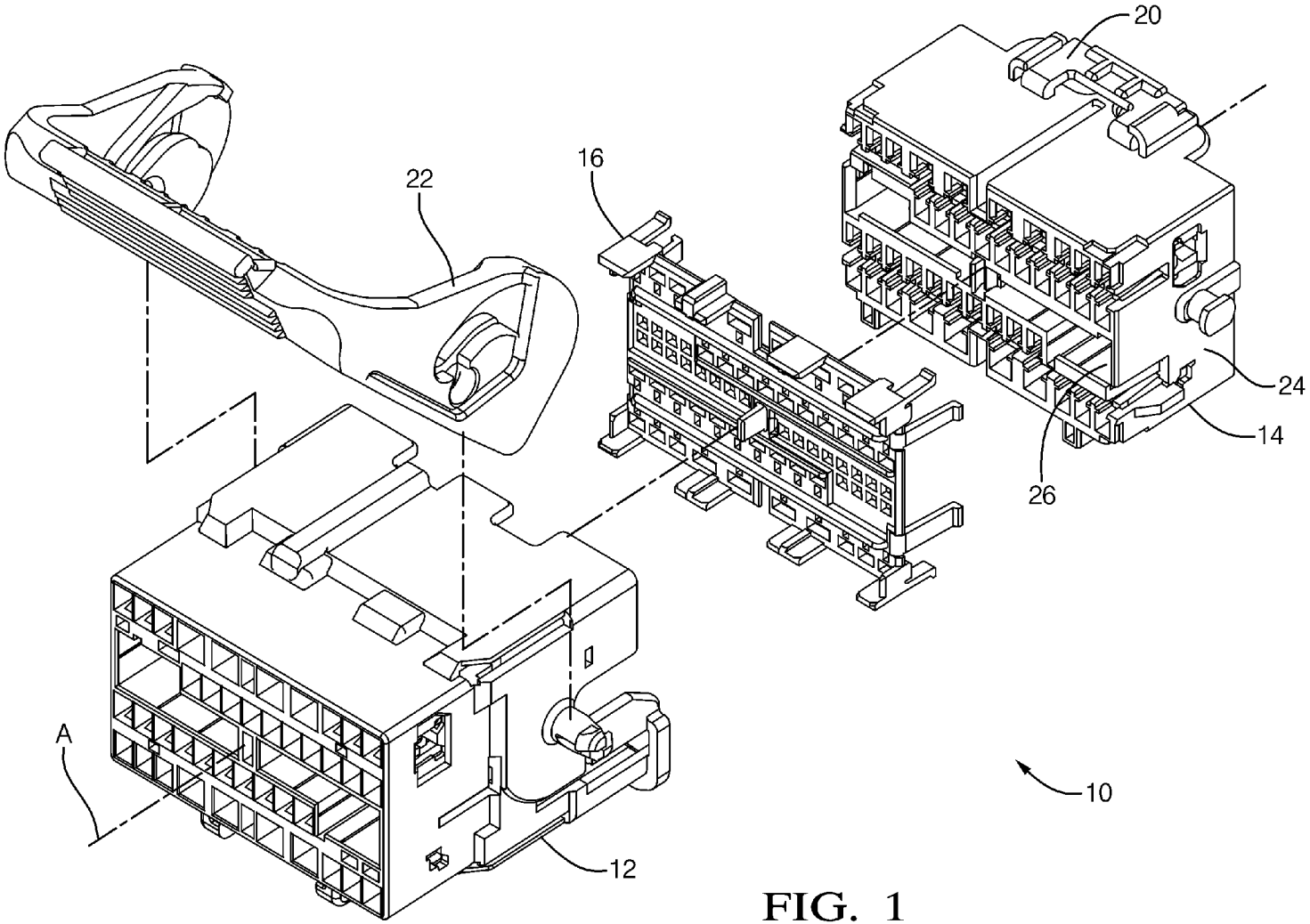
FIG. 1 shows an exploded isometric view of an electrical connector assembly that includes a retractable stabilizer in accordance with the invention.

In accordance with a preferred embodiment of this invention, referring to FIG. 1, a multi-pin electrical connector assembly 10, such as is used in the motorized transportation industry to electrically connect electrical signals to electrical devices disposed in a vehicle includes a male connector 12, a female connector 14, and a retractable stabilizer 16 that is disposed in male connector 12 where retractable stabilizer 16 operates in connector assembly 10 having a low coupling force.

Female connector 14 is releasably coupled to male connector 12 through an open end 18 of male connector 12 to mate together along a mating axis A. The coupling force is needed to couple, or mate connectors 12, 14 and uncouple, or unmate connectors 12, 14. Connectors 12, 14 are formed from an electrically nonconductive dielectric material. For example, the dielectric material may be a plastic material formed from nylon or polyester. Conductors 12, 14 are injection molded using techniques and methods known in the art. Connector assembly 10 is suitably large such that connectors 12, 14, respectively, include a plurality of female terminals (not shown) axially disposed in female connector 14 that electrically connect, or mate to a plurality of male terminals 19 axially disposed in male connector 12 when connectors 12, 14 are mated together. Male terminals 19 in male connector 12 may be different types where some may be a pin-type and others being a blade-type having different blade widths. The corresponding female terminals are different types having different widths that mate with male terminals 19. Male terminals 19 and female terminals are formed of a metallic material, preferably a non-ferrous material. Male terminals 19 are disposed in male connector 12 and may rock or laterally move slightly in male connector 12 in relation to a shroud 24 of male connector 12. Retractable stabilizer 16 acts to pre-align, and stabilize and prevent rocking of male terminals 19. Distal tips of the male terminals 19 project above upper surface 42 when retractable stabilizer 16 is in the blade alignment position 36.

Alternately, the male and female terminals may be of a single blade type used in the connector assembly. Connector assembly 10 includes a connection position assurance lock 20 that secures connectors 12, 14 to each other when connector assembly 10 is mated together. Connector assembly 10 further includes a handle 22 attached to protruding shafts on the male connector 12 and operatively works in combination with female connector 14 to dislodge and unmate female connector 14 from male connector 12. Many configurations of the connection position assurance lock and the handle may be used for connector assembly 10 and are known in the art.

Figure 2:
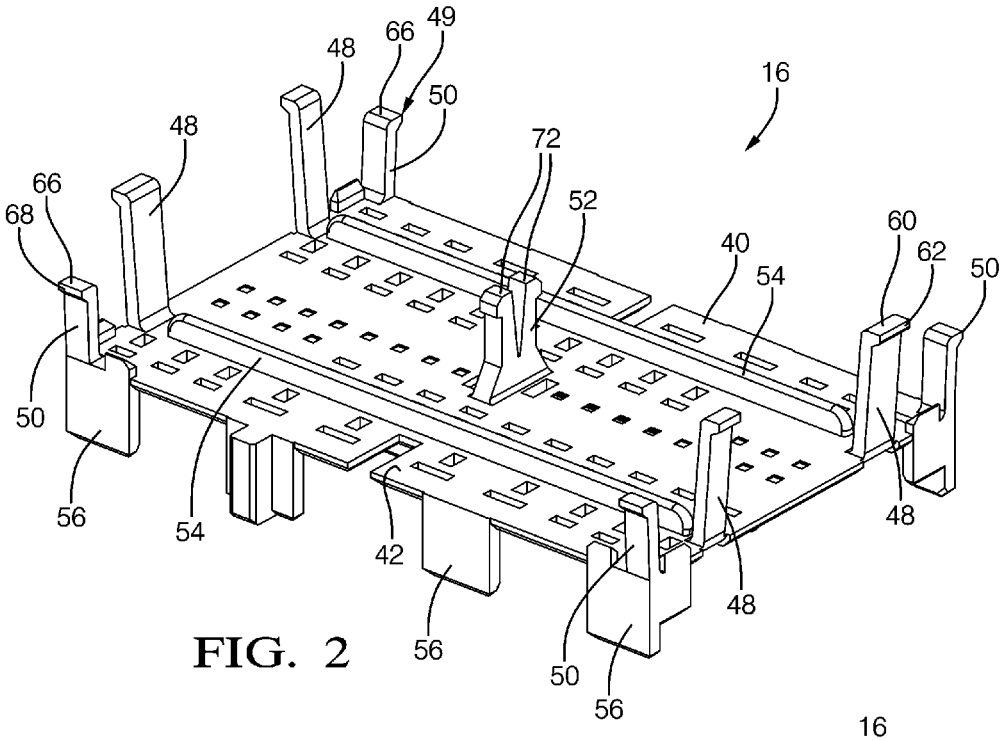
FIG. 2 shows an isometric view of the retractable stabilizer of FIG. 1.
Figure 3:
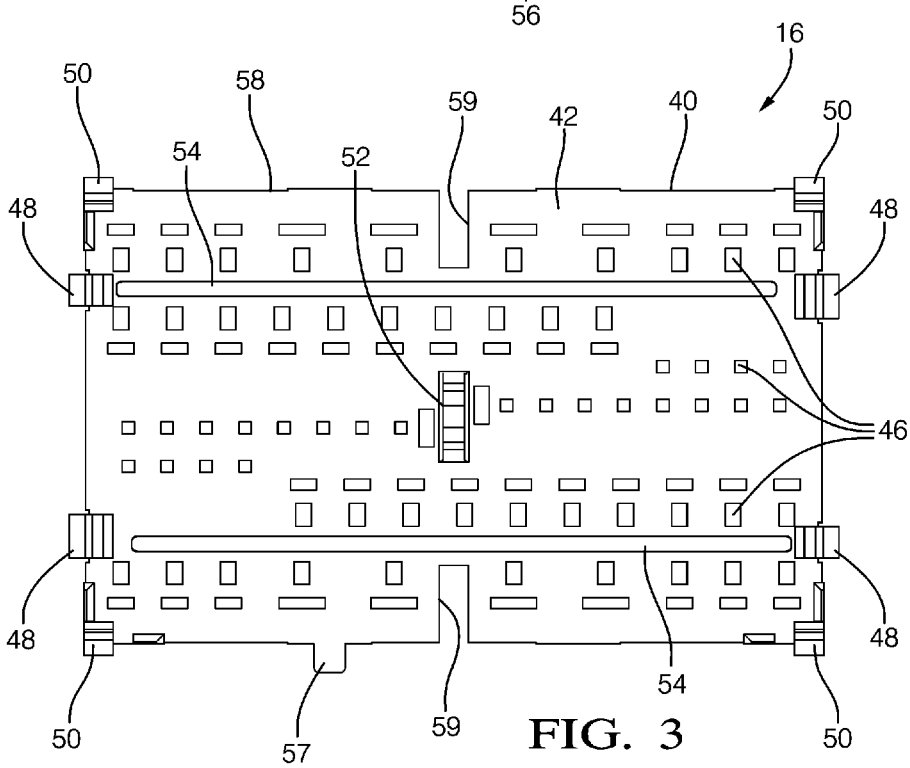
FIG. 3 shows a plan view of the retractable stabilizer of FIG. 2.
Figure 4:
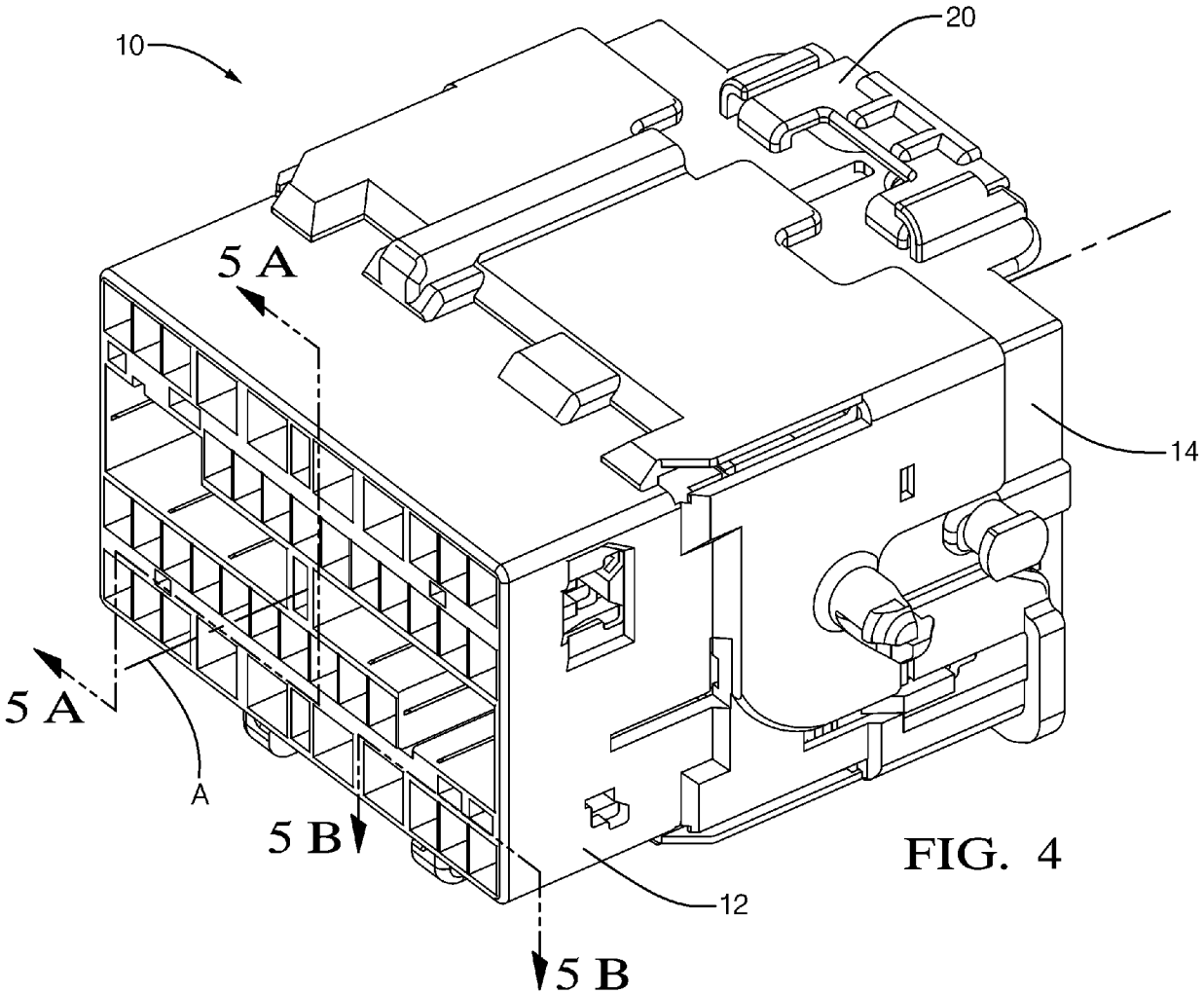
FIG. 4 shows a isometric view of the connector assembly of FIG. 1 not fully mated together where the retractable stabilizer is in a blade alignment position in the male connector, and the female connector is being inserted in the male connector.
Figure 5A:
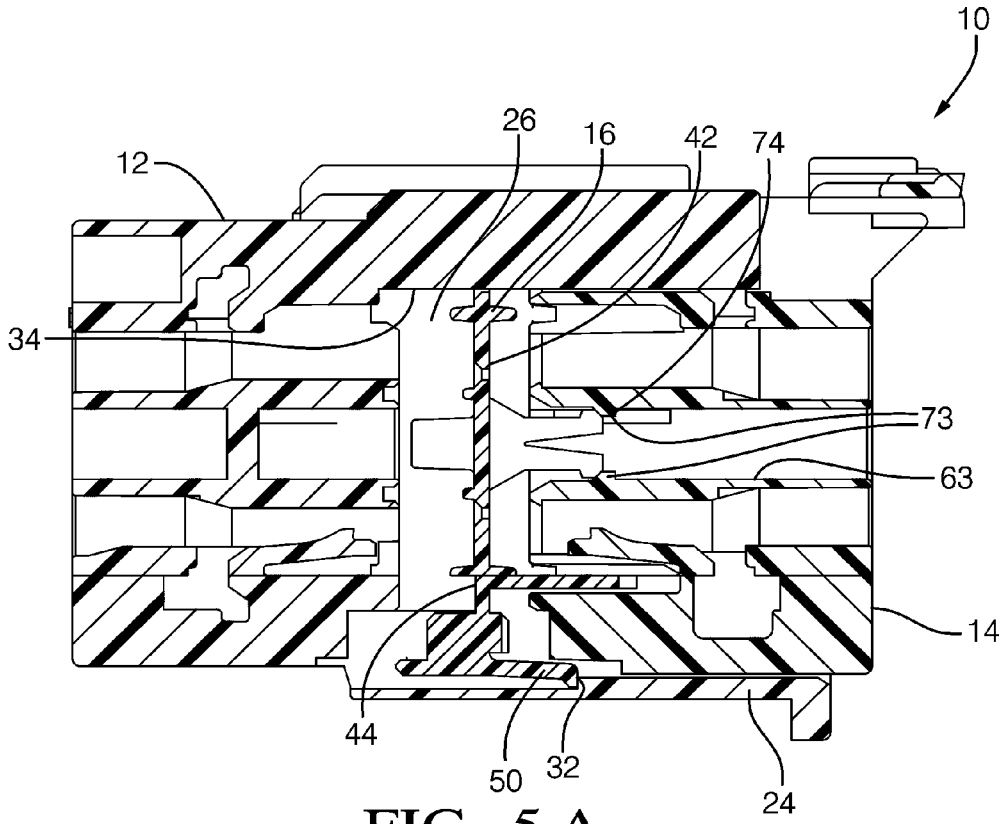
FIG. 5A shows a cross section view of the connector assembly of FIG. 4 through the lines 5A-5A, showing details thereof, the female connector being inserted into the male connector and not yet secured to the securing member on the retractable stablizer.
Figure 5B:
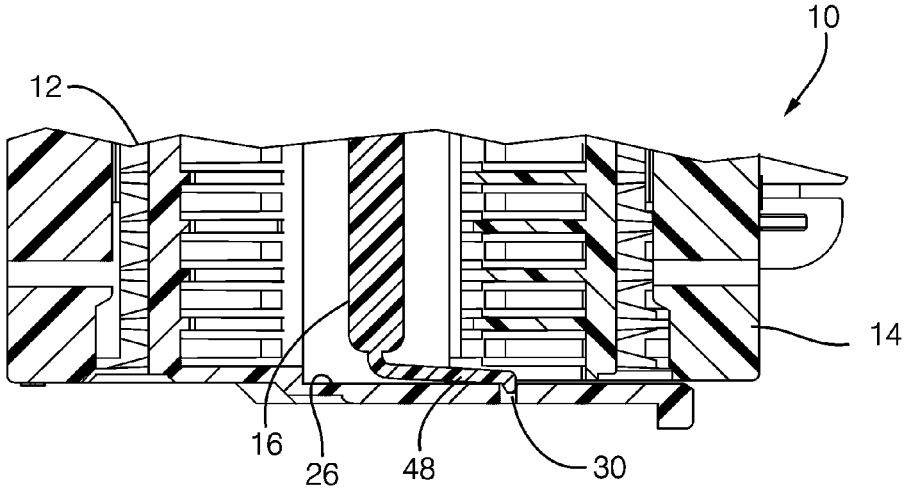
FIG. 5B shows a cross section view of the connector assembly of FIG. 4 through the lines 5B-5B, showing position arm details thereof.
Figure 6:
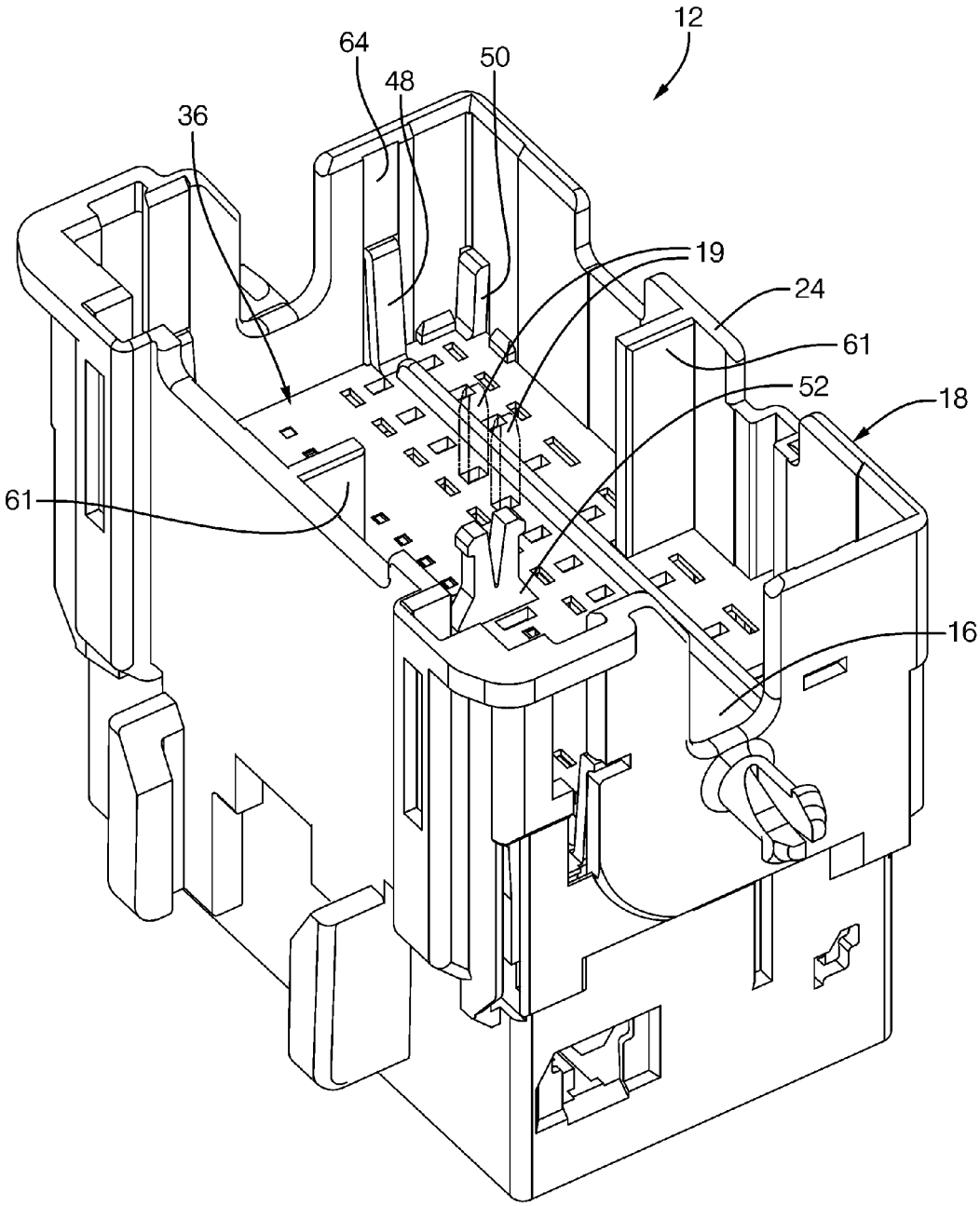
FIG. 6 shows an isometric view of the male connector of the connector assembly of FIG. 1, where the retractable stabilizer is in the blade alignment position and the connector assembly is unmated.
Figure 7A:
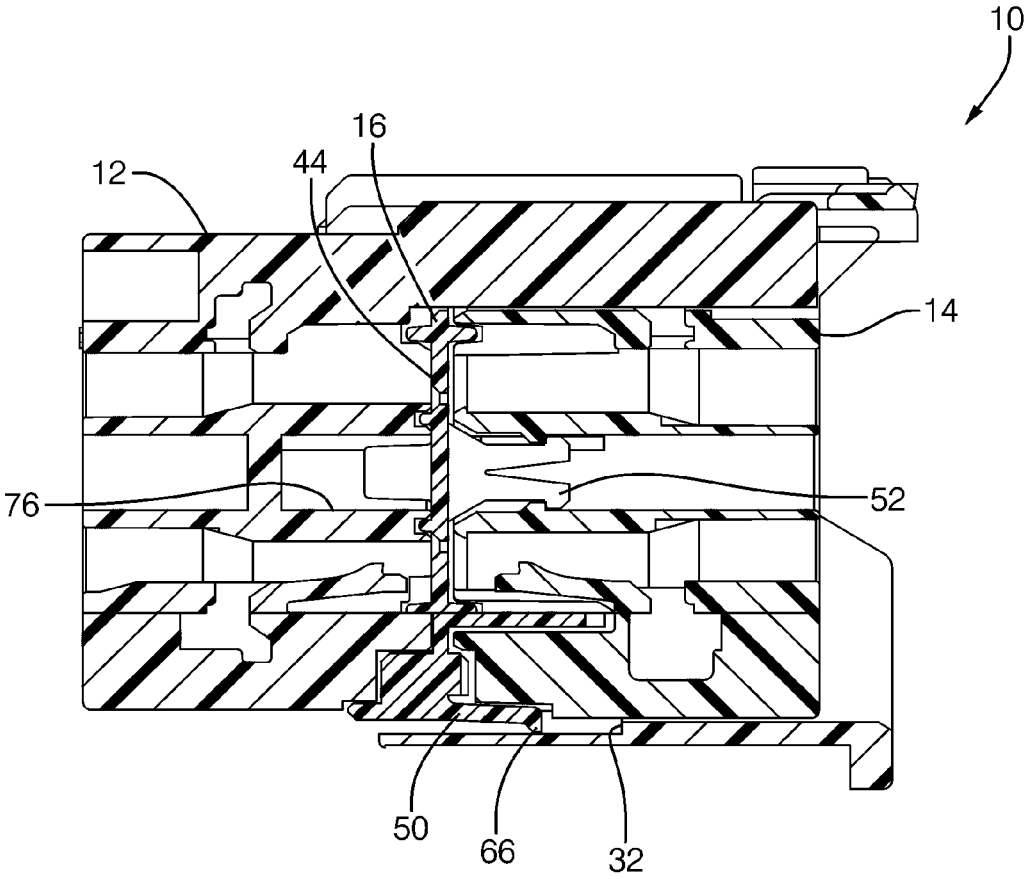
FIG. 7A shows a cross section view of the connector assembly of FIG. 5A where the connector assembly is mated together, the retractable stabilizer is in the seated position, and the female connector is secured to the securing member of the retractable stabilizer.
Figure 7B:
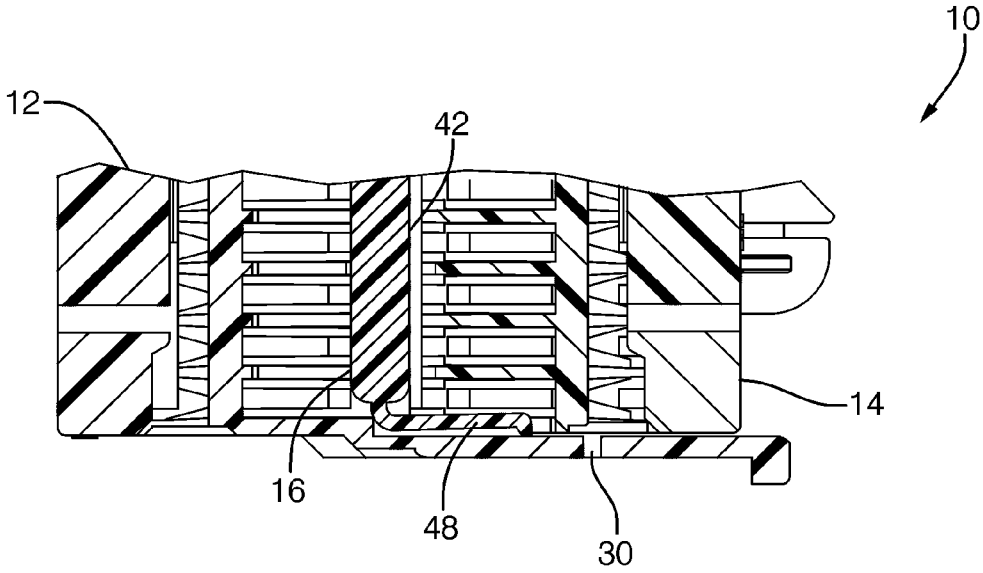
FIG. 7B shows a cross section of the connector assembly of FIG. 5B where the connector assembly is mated together, the retractable stabilizer is in the seated position, showing position arm details thereof.
Figure 8:
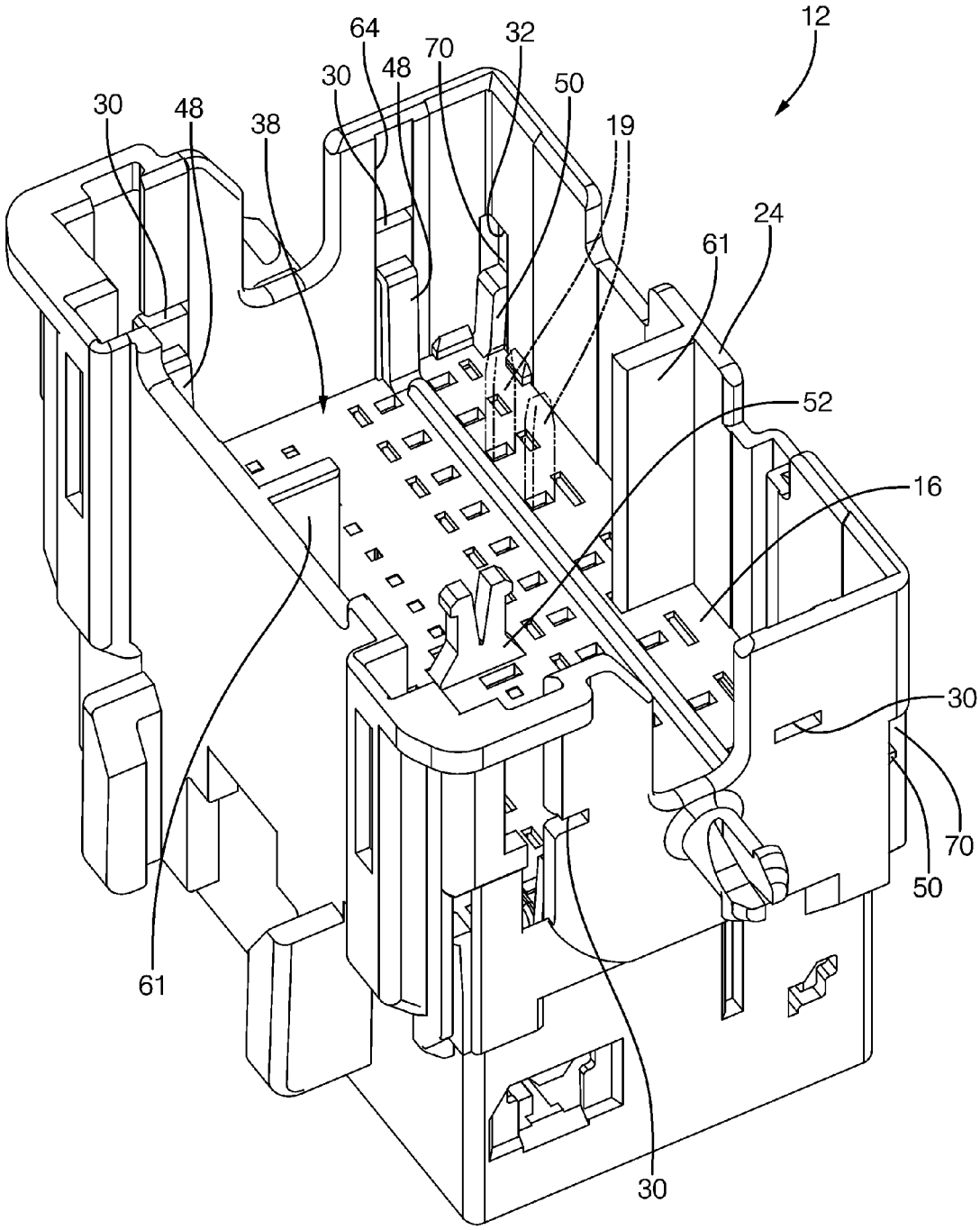
FIG. 8 shows an isometric view of the retractable stabilizer in a seated position in the male connector of the connector assembly of FIG. 1, with the female connector removed to show interior details thereof.

Referring to FIGS. 2-9, male connector 12 includes a forward projecting circumferential housing, or shroud 24. Shroud 24 defines a cavity, blind bore, or alcove 26 and a retractable stabilizer 16 is disposed in alcove 26 generally perpendicular to mating axis A. Retractable stabilizer 16 is generally disposed between shroud 24 of male connector 12 and female connector 12 when connecters 12, 14 are mated together. Retractable stabilizer 16 is formed of a similar material and injection molded similar to connectors 12, 14, as previously described herein. Shroud 24 includes at least one aperture 30 through shroud 24. A blocking feature 32 is disposed on an inner surface 34 of shroud 24. FIGS. 6 and 8 each show a pair of male terminals as a representation of the plurality of terminals in connector assembly 10 and the remaining terminals have been removed to more clearly show the detail of retractable stabilizer 16 inside alcove 26. FIGS. 4, 6, and 8 have connection position assurance lock 20 removed to better show the details of retractable stabilizer 16 in male connector 12.

Retractable stabilizer 16 is moveable between a blade assembly position 36, as best illustrated in FIG. 6, and a fully seated position 38, as best illustrated in FIG. 8, in alcove 26 of shroud 24. Blade assembly position 36 is disposed along axis A in a middle or mid-portion of male connector 12. Seated position 38 is disposed axially rearward of blade assembly position 36 deep in a rear portion of alcove 26. In normal operation, retractable stabilizer 16 is disposed in blade assembly position 36 when connector assembly 10 is unmated and disposed in seated position 38 when connector assembly 10 is mated together. Retractable stabilizer 16 may be snap-fitted into alcove 26 of male connector 12 manually by a human operator or automatically by machine placement in an assembly process. Once retractable stabilizer 16 is snap-fitted into blade assembly position 36 of male connector 12, retractable stabilizer 16 remains disposed in male connector 12. With usage and operation of connector assembly 10, retractable connector 26 still remains disposed in cavity 26, preferably in blade alignment position 36, when connector assembly 10 is unmated.

Referring to FIGS. 2 and 3, retractable stabilizer 16 includes a generally planar base 40 having a first, or upper surface 42 and a second, or lower surface 44 opposite upper surface 42. Base 40 has a rectangular shape and is about the size of a cross section area of alcove 26. Base 40 is sized so that base 40 does not make contact with inner surface 34 of shroud 24 when disposed at positions 36, 38 in male connector 12. When retractable stabilizer 16 moves between positions 36, 38, base 40 moves relatively freely in alcove 26 with little restriction so that base 40 does not provide frictional resistance to movement in shroud 24 during mating and unmating of connector assembly 10 such that the freely moving base 40 assists retractable stabilizer 16 of connector assembly 10 to have a low coupling force. Base 40 defines a plurality of holes 46. Base 40 also includes a plurality of position arms 48, a plurality of retention features 49, at least one securing member 52, a plurality of reinforcement ribs 54, and a plurality of anti-rocking members 56. In one embodiment, retention features 49 include retention arms 50. Arms 48, 50, securing member 52, and ribs 54 extend from upper surface 42 of base 40 towards open end 18 of male connector 12 that receives female connector 14. Anti-rocking members 56 extend from lower surface 44 of base 40 in a direction away from open end 18. Female connector 14 is remote from retractable stabilizer 16 and open end 18 when connecters 12, 14 are unmated. An alignment feature 57 along edge 58 ensures retractable stabilizer 16 is keyed for insertion into alcove 26 in a single way to prevent incorrect installation of retractable stabilizer 16 into alcove 26. Alignment openings 59 along edge 58 in retractable stabilizer 16 align with alignment tabs 61 constructed in alcove 26 to ensure axial movement of retractable stabilizer 16 between positions 36, 38.

Holes 46 have a footprint on base 40 to align with positioned male terminals 19 in male connector 12. Holes 46 have a corresponding size to accommodate and receive male terminals 19. Holes 46 are sufficiently sized to allow male terminals 19 to fit through holes 46 where holes 56 do not provide an interference fit for terminals 19. Thus, holes 56 are sufficiently large for terminals 19 to freely move through holes with marginal frictional force restrictions as retractable stabilizer 16 moves from blade alignment position 36 to seated position 38, yet are sufficiently small to provide support for terminals 19. Holes 46 are inwardly beveled so terminals 19 are easily received in holes 46. Additionally, an area of each hole 46 that makes contact with terminal 19 is minimized as terminal 19 moves through hole 46 assisting to keep the coupling force of retractable stabilizer 16 low.

Referring to FIG. 2, position arms 48 are disposed along an edge 58 of base 40 on the short sides of rectangular base 40. Two position arms 48 are spaced apart along each short side of rectangular base 40 with each arm 48 being positioned near a corner of base 40. Each position arm 48 includes an outwardly facing detent 60 that adjacently faces inner surface 34 of shroud 24 of male connector 12 when retractable stabilizer 16 is disposed in cavity 26. Each detent 60 is in communication with one of plurality of apertures 30 to secure retractable stabilizer 16 to shroud 24 when retractable stabilizer 16 is positioned in blade alignment position 36 when connector assembly 10 is unmated. An outward face 62 of each detent 60 is in slidable communication with a position arm track 64 formed along inner surface 34 of shroud 24 when connector assembly 10 is mated together. Since the cross section area of outward face 62 is small, the frictional forces resulting from the sliding of face 62 in position arm track 64 is at a minimum when connector assembly 10 is mated which assists retractable stabilizer 16 of connector assembly 10 to have a low coupling force. Position arms 48 have a length that is sufficient to allow arms 48 to have resilient outward flexure to engage apertures 30 when retractable stabilizer 16 is in blade alignment position 36. Position arms 48 have resilient inward flexure towards alcove 26 when sliding in position track 64 during the mating and unmating of connector assembly 10. If a length of the position arm is too short, the position arm may not have enough resilient flexure to engage in the apertures to secure the retractable stabilizer in the blade alignment position. If the position arms do not engage in the apertures, the retractable stabilizer may undesirably slide towards the seated position when the connector assembly is unmated. If a length of the position arm is too long, the position arms may not provide the structural support needed for the retractable stabilizer to stabilize the male blades in the male connector. Lack of stabilization of the male blades from the retractable stabilizer may undesirably result in damaged male blades where the connector assembly would require repair which increases costs. Alternately, there may be at least two position arms to provide adequate stabilization of the male blades. Preferably, the at least two position arms are opposingly spaced on different sides of the retraceable stabilizer to provide a balanced securing mechanism for the retractable stabilizer disposed in the blade alignment position.

Retention arms 50 are disposed along edge 58 of base 40 at the corners of rectangular base 40. Preferably, retention arms 50 are disposed proximate position arms 48 to provide a structural balance to retractable stabilizer 16 when being positioned in blade alignment position 36. Each retention arm 50 includes an outwardly facing stop 66 that faces shroud 24 of male connector 12 when retractable stabilizer 16 is disposed in cavity 26. Each stop 66 is in communication with blocking feature 32 to stop travel of retractable stabilizer 16 in male connector 12 from going past blade alignment position 36 when connector assembly 10 is unmated. Blocking feature 32 is a shoulder constructed along inner surface 34 of male connector 12. An outward face 68 of each stop 66 is in slidable communication with a retention arm track 70 formed in shroud 24 when connector assembly 10 is mated together. Since the cross section area of outward face 68 of each stop 66 is small, the frictional forces resulting from the sliding of face 68 in retention arm track 70 is minimized when connector assembly 10 is mated that assists retractable stabilizer 16 of connector assembly 10 to have a low coupling force. Retention arms 50 have a length that work in combination with the disposition of blocking feature 32 on male connector 12 to stop retractable stabilizer 16 at a depth in male connector 12 that is effective to position the retractable stabilizer at blade alignment position 36, as shown in FIG. 6. The faces 62, 68 of position and retention arms 48, 50 only slidingly engage inner surface 34 of male connector 12 when connector assembly 10 is mated and unmated that assists to ensure a low coupling force of retractable stabilizer 16. Thus, the movement of retractable stabilizer 16 between positions 36, 38 requires very little coupling force so as to marginally negatively affect the coupling force needed for mating and unmating of connector assembly 10. In one embodiment, position arms 48 have a first length and retention arms 50 have a second length, and the first length of position arms 48 is greater than the second length of retention arms 50. The length of the retention arms are dependent on the geometries of the connector assembly and the male terminal feature content in the male connector which may affect how the male connector interacts with the female connector when the connector assembly is mated and unmated. Alternately, the retention feature may not be an arm that has a length so that the stops and the faces of the retention feature may be incorporated at the edge of the base of the retractable stabilizer. The blocking feature would be correspondingly positioned along the inner surface of the shroud of the male connector to interact with the retention feature disposed at the edge of the base so that the retractable stabilizer is still appropriately positioned in the blade alignment position at a depth as shown in FIG. 6.

Securing member 52 is disposed inbound edge 58 of base 40 and is co-axially located at a center of base 40 to provide uniform draw of retractable stabilizer 16 back to blade alignment position 36. Securing member 52 is received into a cavity area 63 in female connector 14 when connectors 12, 14 are mated and securing member 52 is configured to release female connector 14 when retractable stabilizer 16 is disposed at blade assembly position 36 as connector assembly 10 is unmated. Securing member 52 has a V-shape. A base portion of the V-shape is secured at upper surface 42 of base 40 and the extended members of the V-shape extend outwardly angularly away from upper surface 42 of base 40. Ends of the extended members include outwardly facing nibs 72 that communicate with shoulders 74 of female connector 14 when connector assembly 10 is mated together. A desired length of the extended members of the V-shape of the securing member 52 are configured and sized so that the female connector retains securing member 52 until retractable stabilizer 16 reaches blade alignment position 36 and then the extended members have inward flexure towards each other when an engagement force of female connector 14 against the extended members of the V-shape is greater than a retention force of the extended members of the V-shaped securing member have against shoulders 74 of female connector 14 when connector assembly 10 is unmated. This is required for female connector 14 to disengage from securing member 52 and leave retractable stabilizer 16 in blade alignment position 36. If the extended members have a shorter length than the desired length, they may have less flexibility and require more coupling force for the female connector to engage and disengage the securing member. If the extended members have a length greater than the desired length, they may flex too easily and the female connector may disconnect from the securing member before the retractable stabilizer is returned to the blade alignment position. As shown in FIG. 2, securing member 52 has a length that is less than a length of position arm 48. In other embodiments the securing member may have a length that is about the same or greater than the position arms, especially in different connector assembly geometries. Alternately, additional securing members may be utilized, especially for connector assemblies having larger geometries. Additional securing members may be positionally disposed on the base to provide a uniform draw or pull of the retractable stabilizer back to the blade alignment position.

At least one reinforcement rib 54 is formed in base 40. Two ribs 54 are shown in FIG. 2 that are spaced apart perpendicular to axis A to provide structural support and added strength for retractable stabilizer 16. This may allow less material to be used in the construction of the retractable stabilizer making for a lighter weight connector assembly. Female connector 14 makes contact with ribs 54 without making contact with said upper surface 42 when connector assembly 10 is mated together so that contact between female connector 14 and retractable stabilizer 16 is minimized that may assist retractable stabilizer 16 of connector assembly 10 to have a low coupling force. If ribs 54 are not present, base 40 may undesirably warp and possible break, especially when the connector system is unmated. With either undesired scenario, the retractable stabilizer's function of stabilizing the male blades in the male connector during the mating and unmating of the connector assembly may be compromised.

Anti-rocking members 56 extending from lower surface 44 of base 40 fit into cavity spaces 76 created in male connector 14 when connectors 12, 14 are mated. Members 56 extend along a length of a long side of rectangular base 40 being spaced apart from one another. Another anti-rocking member extends from lower surface 44 opposite securing member 52 that also assists to structurally align male terminals 19 during movement of retractable stabilizer 16 between positions 36, 38. Members 56 assist to prevent off-axial movement of retractable stabilizer 16 that may undesirably bend or damage male terminals 19. Members 56 and spaces 76 are sized to make contact only if retractable stabilizer is tilted off-axis during mating or unmating of female connector 14 from connector assembly 10. The sizing of cavity spaces 76 keeps retractable stabilizer 16 from being tilted sufficiently far that may bend and damage terminals 19. Since there is no frictional contact between members 56 and spaces 76 during mating an unmating of connector assembly 10, this assists retractable stabilizer 16 of connector assembly 10 to have a low coupling force. Rocking members 56 ensure movement of retractable stabilizer 16 occurs in axial direction between positions 36, 38 to best stabilize and protect male terminals 19 when connector assembly 10 is mated and unmated.

When male and female connector 12, 14 are not mated, female connector 14 is remote from open end 18 of male connector 12. Retractable stabilizer 16 is disposed in blade alignment position 36 of alcove 26 of male connector 12. Detents 60 on position arms 48 are disposed in apertures 30 and stops 66 of retention arms 50 are adjacent blocking features 38 in male connector 12, as best illustrated in FIG. 6. Retractable stabilizer 16 may be referred to as a floating stabilizer, as about 0.5 Newton (N) of force is needed to hold each position arm in aperture 30 of male connector 12 to keep retractable stabilizer 16 in blade alignment position 36.

Referring to FIGS. 4, and 5A-5B, when male and female connector 12, 14 are mated, female connector 14 is inserted into open end 18. Female terminals (not shown) engage distal tips of male terminals 19 disposed above upper surface 42 of retractable stabilizer 16. As the connection process continues, female connector 14 engages securing member 52. Nibs 72 of extending members of securing member 52 slide along a surface of cavity area 63 of female connector 14 receiving securing member 52 and ride over tabs 73 in cavity area 63 to seat at shoulders 74. A forward face of female connector 14 engages ribs 54 of retractable stabilizer 16. Referring to FIGS. 7A-7B, the coupling force against ribs axially urges retractable stabilizer 16 away from blade alignment position 36 to seated position 38. Position arms 48 flex inward towards alcove 26 to sliding engage position tracks 64 along faces 62 of position arms 48. Retention arms 50 slidingly engage retention tracks 70 along faces 68 of retention arms 50. Retractable stabilizer 16 attains seated position 38 when lower surface 44 of retractable stabilizer 16 contacts a surface of male connector 12 deep in cavity 26.

Figure 9A:
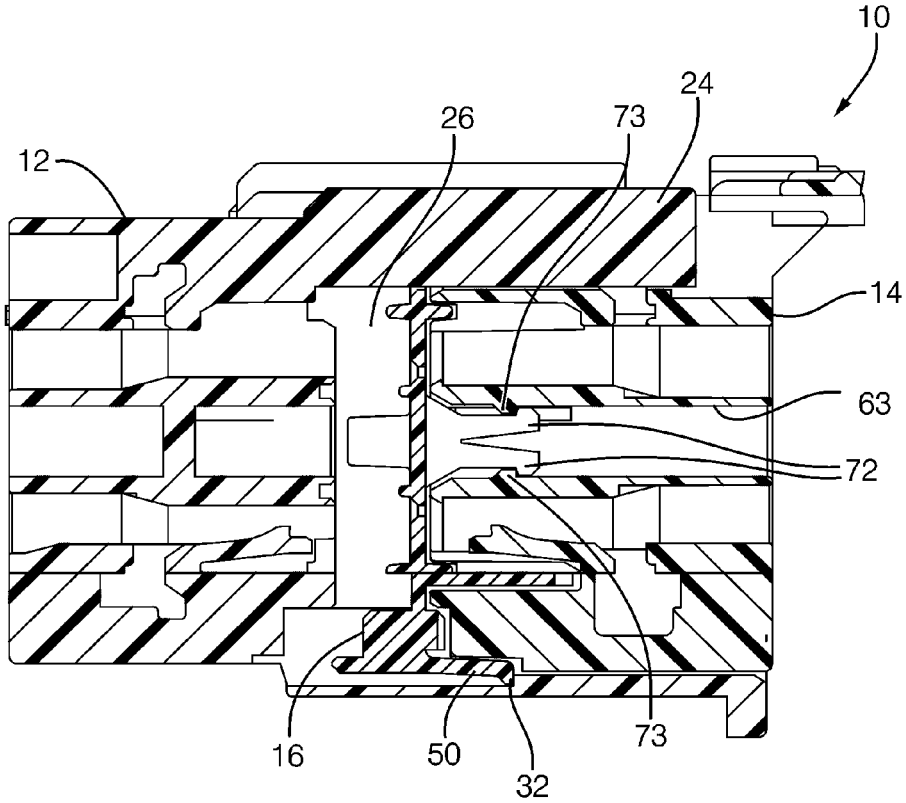
FIG. 9A shows a cross section of the connector assembly of FIG. 7A, and the female connector pulls the securing member to move the retractable stabilizer back to the blade alignment position, just before release of the female connector from the securing member.
Figure 9B:
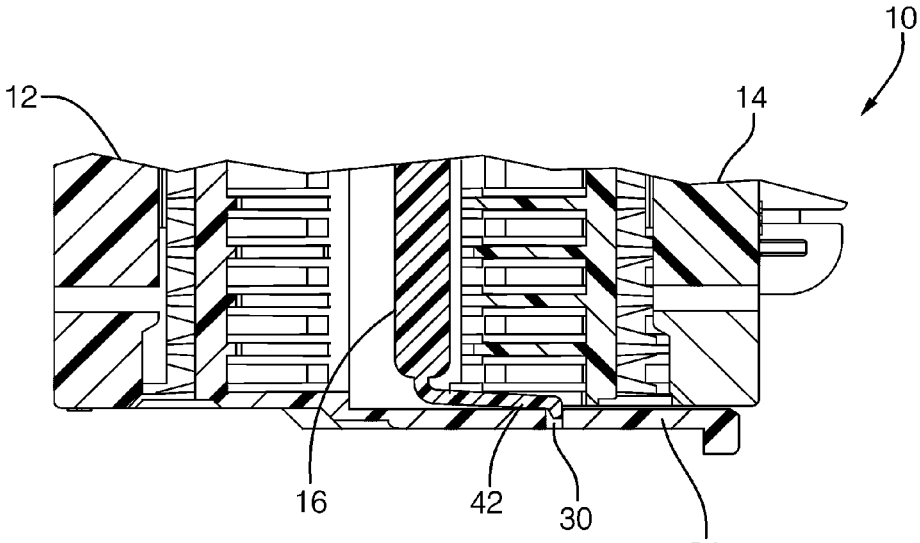
FIG. 9B shows a cross section of the connector assembly of FIG. 7B, and the female connector pulls the securing member to move the retractable stabilizer back to the blade alignment position, the position arm flexing into the aperture in the shroud of the male connector, just before release of the female connector from the securing member.

Referring now to FIGS. 9A-9B, when male and female connector 12, 14 are unmated, female connector 14 pulls against securing member 52 locked at shoulders 74. Retractable stabilizer 16 moves from seated position 38 towards blade alignment position 36. The female terminals (not shown) increasingly unconnect from male terminals 19 as base 40 stabilizes male terminals while a decreasing portion of male terminals 19 remain above upper surface 42. When stops 66 of retention arms 50 engage blocking features 32 on male connector 12, forward motion of retractable stabilizer 16 is halted in alcove 26. Detents 60 on position arms 48 align with apertures 30 so that detents 60 of position arms 48 flex into apertures 30 securing retractable stabilizer 16 at blade alignment position 36. As female connector 14 continues to disconnect from male connector 12, blocking features 32 hold retractable stabilizer at blade alignment position 36 and extending members of securing member 52 engaging female connector 14 flex inward as tabs 73 ride over nibs 72. When tabs 73 are free of nibs 72, female connector 14 is free from retractable stabilizer 16. Female terminals (not shown) disconnect from distal ends of male terminals 19 while female connector disconnects from shroud 24 of male connector 12 making female connector 14 free from male connector 12 completing the uncoupling of connector assembly 10.

To operate retractable stabilizer 16, during the mating and unmating of connector assembly 10, about 10 N of coupling force is needed. In one embodiment, for example, to mate and unmate the entire connector assembly 10 including retractable stabilizer 16, male terminal 19, and female terminals (not shown), may take about 75 N of coupling force. Prior art retractable stabilizer connection systems having a similar geometry to connector assembly 10 including retractable stabilizer 16 may require greater than 10 N of coupling force to operate the retractable stabilizers in these connection systems. In one such prior art retractable stabilizer connection system having similar geometry as connector assembly 10, the coupling force needed to operate the retractable stabilizer may be upwards of 70% greater than connector assembly 10.

Alternately, for clarification and not by way of limitation, the geometries of the base, position arms, retention arms, and the securing member and other elements of the low coupling force retractable stabilizer may be sized according to the geometries of the connector assembly being employed.

Thus, a reliable connector assembly is provided that includes a retractable stabilizer having low coupling force where the retractable stabilizer stabilizes the male terminals in the male connector when the connector assembly is mated and unmated. The retractable stabilizer only slidingly connects with an inner surface of the male connector along the faces of the position arms and retention feature when the retractable stabilizer moves between the blade alignment position and the seated position in an alcove of the male connector that assists the retractable stabilizer to have a low coupling force. The retractable stabilizer in the connector assembly may be operated with about a 10 N coupling force during the mating and unmating of the connector assembly. The holes in the base receiving the male terminals are sized to not provide frictional forces during movement of the retractable stabilizer between the blade alignment position and the seated position that also assists to ensure the retractable stabilizer of the connector assembly has a low coupling force. The reinforcement ribs add strength to the retractable stabilizer so that the retractable stabilizer may be constructed with less material and may keep the retractable stabilizer from undesirably buckling, warping, or breaking during operation of the connector assembly. The position and retention arms are disposed along an edge of the retractable stabilizer to allow convenient engagement with the apertures and blocking features disposed on an inner surface of the shroud of the male connector. An alignment feature along the edge of the retractable stabilizer spaced apart from the axis allows the retractable stabilizer to be keyed for correct positional insertion into the alcove of the male connector. Alignment features in the retractable stabilizer align with axial tabs disposed in the alcove of the male connector to keep the retractable stabilizer axially aligned when moving between the blade alignment position and the seated position. Anti-rocking members of the retractable stabilizer prevent off-axis tilting of the retractable stabilizer and ensure axial movement of the retractable stabilizer between the blade alignment and seated position over repeated cycles of operation of the connector assembly. The anti-rocking members may prevent damage to the male terminals in the male connector.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector assembly comprising:

a female connector; and a male connector releasably coupled to said female connector along a mating axis so that a plurality of female terminals disposed in the female connector are matable to a plurality of terminals disposed in the male connector, the male connector including a cavity, and a generally planar retractable stabilizer is receivably coupled in the cavity, said male connector defining at least one aperture therethrough and at least one blocking feature disposed along an inner surface of the male connector in the cavity, said retractable stabilizer movable in said cavity between a blade alignment position when the female and the male connector are unmated and a seated position when the female and the male connector are mated together, the seated position being axially remote from the blade alignment position, said retractable stabilizer including, a base defining a plurality of holes therethrough adapted for receiving the plurality of terminals of the male connector, the base including, at least one position arm extending from a surface of the base and in communication with the at least one aperture for securing the retractable stabilizer in the blade alignment position when the female and the male connector are unmated, at least one retention feature in communication with the blocking feature to prevent the retractable stabilizer from moving beyond the blade alignment position in the cavity when the female and the male connector are unmated, and a yieldable, inward flexing securing member extending from the base, the inward flexing securing member flexing inward when in communication with the female connector when the female and the male connector are mated together to releasably couple the retractable stabilizer to the female connector, and the inward flexing securing member further flexing inward so that the female connector is releasable from the retractable stabilizer when the retractable stabilizer is disposed at the blade alignment position when the female and the male connector are unmated.

2. The electrical connector assembly according to claim 1, wherein the at least one position arm is spaced apart from the at least one retention feature, and the at least one position arm comprises a detent having a face and the at least one retention feature comprises an arm having a stop and the stop including a face, and only said faces of said position arm and said retention arm of the retractable stabilizer slidingly engage the inner surface of respective tracks defined in the inner surface of the male connector within the cavity when the connector assembly is mated and unmated, whereby a low coupling force of the retractable stabilizer of the connector assembly is attained.

3. The electrical connector assembly according to claim 1, wherein the at least one position arm extends generally perpendicular to the surface of the base, said at least one position arm comprises a flexible at least one position arm, said flexible position arm flexably communicating with said aperture, and wherein the base further includes, an alignment feature extending from an edge of the base to ensure the retractable stabilizer is receivably coupled in the cavity of the male connector in a single way.

4. The electrical connector assembly according to claim 1, wherein the at least one retention feature is an arm extending from the surface of the base, and when the retractable stabilizer is disposed in the seated position the at least one position arm, the at least one retention arm, and the inward flexing securing member axially extend from the surface of the base toward an open end of the male connector that receives the female connector.

5. The electrical connector assembly according to claim 1, wherein the at least one position arm is independent from the at least one retention feature, and the at least one position arm and the at least one retention feature are disposed at an edge of the base and the inward flexing securing member is disposed on the surface of the base in-bound said edge.

6. The electrical connector assembly according to claim 5, wherein the base of the retractable stabilizer comprises corners and the at least one retention feature is disposed at least at one of the corners.

7. The electrical connector assembly according to claim 6, wherein the retractable stabilizer comprises a rectangular shape and four retention features, a retention feature being disposed at each corner.

8. The electrical connector assembly according to claim 7, wherein the rectangular shape has short sides, and the at least one position arm is disposed along at least one of the short sides of the rectangle proximate a retention feature.

9. The electrical connector assembly according to claim 8, wherein the at least one position arm comprises four position arms and the four position arms are disposed along said short sides of said rectangle, two of the position arms being disposed on one of the short sides of the rectangle, the other two position arms being disposed along the other short side of said rectangle.

10. The electrical connector assembly according to claim 1, wherein the inward flexing securing member is V-shaped, a base portion of said V-shape being secured to the base of the retractable stabilizer, and extended members of the V-shape include nibs communicating with shoulders of the female connector when the female connector and the male connector are at least mated together.

11. The electrical connector assembly according to claim 10, wherein the inward flexing securing member is co-axially disposed on said base, and the extended members of said V-shape extend angularly away from the axis.

12. The electrical connector assembly according to claim 1, wherein the base of the retractable stabilizer further includes, at least one reinforcement rib.

13. The electrical connector assembly according to claim 1, wherein the base further includes a lower surface that faces away from an open end of the male connector that receives the female connector when the retractable stabilizer is disposed in the cavity, and the base of the retractable stabilizer further includes, at least one anti-rocking member that extends from the lower surface of the base in a direction away from the open end.

14. The electrical connector assembly according to claim 1, wherein the retractable stabilizer includes a plurality of tracks defined in the inner surface of the male connector within the cavity, and a portion of the plurality of tracks receive the at least one retention feature when the retractable stabilizer is receivably coupled in the cavity, and the at least one retention feature includes a stop and the portion of the plurality of tracks includes a blocking feature, and the stop of the at least one retention feature engages the blocking feature when the female connector is unmated from the male connector such that the retractable stabilizer is disposed at the blade alignment position within the cavity.

15. An electrical connector assembly comprising:

a male connector releasably coupled to a female connector so that a plurality of female terminals disposed in the female connector are matable to a plurality of male terminals disposed in the male connector; and a retractable stabilizer disposed in a cavity of said male connector so as to receive male terminals disposed in the male connector, said retractable stabilizer being disposed in a blade alignment position when said connectors are unmated and a seated position when said connectors are mated together, the retractable stabilizer including, a base including, at least one position arm, at least one retention feature, at least one yieldable, inward flexing securing member, and at least one reinforcement rib.

16. The electrical connector assembly according to claim 15, wherein the at least one position arm comprises a detent having a face and the at least one retention feature comprises an arm having a stop and the stop including a face, and only said faces of said position arm and said retention arm of the retractable stabilizer slidingly engage in respective tracks defined in an inner surface of the cavity of the male connector when the female and the male connector are mated and unmated.

17. The electrical connector assembly according to claim 15, wherein the at least one position arm comprises a flexible at least one position arm, said flexible position arm flexably communicating with an aperture defined therethrough in a shroud of the male connector when the female and male connector are unmated.

18. The electrical connector assembly according to claim 15, wherein the male connector-receives the female connector through an open end in the male connector, the at least one position arm and the at least one inward flexing securing member extend towards said open end.

19. The electrical connector assembly according to claim 15, wherein the position arm and the retention feature are respectively disposed at an edge of the base.

20. The electrical connector assembly according to claim 1, wherein the inward flexing securing member is V-shaped, a base portion of said V-shape being secured to the base of the retractable stabilizer, and extended members of the V-shape include nibs communicating with shoulders of the female connector when the connector assembly is mated together.

* * * * *